US005829288A

United States Patent [19]

Serruys

[11] Patent Number: 5,829,288

[45] Date of Patent: Nov. 3, 1998

[54] ADAPTIVE FOLDING

[75] Inventor: Wim Serruys, Moorsele, Belgium

[73] Assignee: L.V.D. Company N.V., Gullegem, Belgium

[21] Appl. No.: 602,804

[22] PCT Filed: Aug. 26, 1994

[86] PCT No.: PCT/BE94/00052

§ 371 Date: Jun. 24, 1996

§ 102(e) Date: Jun. 24, 1996

[87] PCT Pub. No.: WO95/05905

PCT Pub. Date: Mar. 2, 1995

[30] Foreign Application Priority Data

Aug. 27, 1993 [BE] Belgium ..... 9300884

[51] Int. Cl.[6] ..... B21D 5/01

[52] U.S. Cl. ..... 72/17.1; 72/19.8; 72/20.1; 72/21.4; 72/389.3; 72/389.6; 72/702

[58] Field of Search ..... 72/16.1, 17.1, 72/17.3, 19.8, 20.1, 21.4, 389.3, 389.6, 702

[56] References Cited

U.S. PATENT DOCUMENTS

| | | | |
|---|---|---|---|
| 4,489,586 | 12/1984 | Hess | 72/389.3 |
| 4,511,976 | 4/1985 | Graf | 364/474 |
| 4,550,586 | 11/1985 | Aubert et al. | 72/389 |
| 4,552,002 | 11/1985 | Haenni et al. | 72/19 |
| 4,753,100 | 6/1988 | Hanni | 72/389.3 |
| 4,772,801 | 9/1988 | Fornerod et al. | 250/561 |
| 4,802,357 | 2/1989 | Jones | 72/389.3 |
| 4,819,467 | 4/1989 | Graf et al. | 72/8 |
| 4,864,509 | 9/1989 | Somerville et al. | 364/476 |
| 4,962,654 | 10/1990 | Zbornik | 72/8 |
| 5,060,495 | 10/1991 | Naoomi et al. | 72/10 |
| 5,062,283 | 11/1991 | Miyagawa et al. | 72/10 |
| 5,285,668 | 2/1994 | Tokai | 72/389.3 |
| 5,483,750 | 1/1996 | Ooenoki et al. | 72/389.3 |

FOREIGN PATENT DOCUMENTS

| | | | |
|---|---|---|---|
| 0 055 435 | 7/1982 | European Pat. Off. . | |
| 0 096 278 | 12/1983 | European Pat. Off. . | |
| 0 108 718 | 8/1984 | European Pat. Off. . | |
| 0 166 351 | 1/1986 | European Pat. Off. . | |
| 0 224 437 | 6/1987 | European Pat. Off. . | |
| 0 341 211 | 10/1990 | European Pat. Off. . | |
| 2362722 | 3/1978 | France | 72/389.3 |
| 2044199 | 3/1972 | Germany . | |
| 57-168725 | 10/1982 | Japan | 72/389.3 |
| 57-202928 | 12/1982 | Japan | 72/389.3 |
| 228612 | 9/1989 | Japan | 72/702 |
| WO 88/01916 | 3/1988 | WIPO . | |

*Primary Examiner*—David Jones
*Attorney, Agent, or Firm*—Seidel, Gonda, Lavorgna & Monaco, PC

[57] ABSTRACT

A method and device for folding a metal sheet to a well-defined angle, in which the sheet is deformed in the recess of a die through a punch being moved above the recess and pressing on the sheet, towards the die, until it reaches a well-defined end position. The movement of the punch is regulated as a function of the folding force and of the folding angle. The punch is moved in the direction of the die until it is in an end position Ya corresponding to: Ya=Yt−dYw−dYr in which Yt is a calculated position, dYw is determined through extrapolation of the course of the folding angle as a function of the position of the punch, and dYr is the correction of the position of the punch which is necessary to compensate for the spring-back of the sheet.

16 Claims, 2 Drawing Sheets

ADAPTIVE FOLDING

BACKGROUND OF THE INVENTION

The present invention relates to a method for folding a metal sheet to a well-defined angle.

In a known method, a metal sheet is deformed in a recess of a die through a pressure means being moved above the recess, pressing on the sheet, towards the die until it reaches a well-defined end position.

The punch is then raised again, and the sheet springs back elastically a little. The difference in angle between the situation in which the sheet is clamped between the punch in its minimal position and the vee-block and the situation in which the sheet is entirely clear of the tools is known as the spring-back.

In order to form a fold with a desired angle, the Y-position which the punch must assume is determined by means of a folding formula or table. Folding formulae and tables only take account of the sheet thickness and the V-opening. They generally do not take account of material properties such as tensile strength and rolling direction, but the latter also influence the folding angle obtained. The folding angle actually obtained will therefore be only approximately the same as the desired folding angle.

After the sheet is clear of the tools, the angle obtained is measured. On the basis of the deviation in angle, a calculation of the correction necessary on the Y-position of the punch is made. A fold is made in a new sheet taking into account the correction in Y, and the result is measured again. This is iterated until the fold angle obtained lies within the desired accuracy limits.

It is important to point out that the folding formula which gives the Y-position as a function of the desired angle is only an approximation. For, the angle obtained greatly depends on the material used, the composition of the material, the texture of the material, the direction of the fold relative to the rolling direction, and the thickness of the material. All these parameters which influence the angle obtained ensure that, for each fold, the correction must be established experimentally in order to obtain a fold within the desired accuracy limits.

The angle can also be measured in each case only after the sheet is clear of the tools, which is when the spring-back has been completed. It goes without saying that this experimental optimization of the folding angle is laborious and time-consuming. Moreover, it is always necessary to make a number of test pieces, which are wasted.

In the case of modern folding presses, the folding formula is incorporated in the control system. The operator thus merely has to enter his experimentally measured angle in the control system. The control system then automatically calculates the correction on the Y-position for the next test piece, but here again the angle is still measured manually, the optimization is still laborious, and worthless test pieces have to be made.

This has to be carried out for each fold of a particular workpiece. Once all folds of a particular workpiece have been optimized, production of a series of the same pieces can be commenced. It is then assumed that all pieces of the range are so similar that the corrections applied, which were optimal for the first piece, are applicable to all pieces. Needless to say, thickness variations, variations in material properties and a different orientation relative to the rolling direction will cause a deviation in the angle obtained.

The method according to the invention is a method by means of which the folding to the desired folding angle is optimized during the making of the fold, i.e. it is an adaptive folding method.

A number of adaptive folding methods are known. Such methods are:

a. Method in which the Force as a Function of the Lowering of the Punch is Measured Methods which measure the force as a function of the position of the punch aim to derive a number of material properties and thickness deviations therefrom. A mathematical model is then used with such data to forecast up to what position (lowering) the punch must go in order to obtain the desired angle.

The force is measured by a force transducer (for example, strain gauges) which is disposed along the force path. The position is given by the linear encoders already present on the folding press. Such a method can give good results only insofar as the model corresponds to the actual properties of the material and the folding process. This method does make it possible to work with standard tools.

b. Method in which the Folding Angle is Measured Contactlessly with a Vision System In the case of this method a 2-dimensional image of the folded sheet is formed through projection. The folding angle is then measured on it. The punch is thus driven downwards until a desired measured angle is detected. A certain correction is calculated for the spring-back.

The vision system also works with standard tools, but it has great limitations. It often happens that an edge which has already been folded impedes the projection of the fold. In those cases the system cannot work because of the absence of measurement.

Another problem is that in the case of long sheets the angle on the left can differ from that on the right. The projection will give an overall image which corresponds neither to the folding angle on the left nor to the folding angle on the right.

c. Method in which the Gap between the Sheet and the Vee-Block is Measured Contactlessly In the case of this method, a special vee-block which generates a signal which changes as a function of the distance of the sheet in the vee-block from the wall inside the vee-block, is used. It is generally a variant of inductive measuring of a position.

The disadvantage is that the vee-block becomes too broad, with the result that short folds become impossible. Besides, an expensive special vee-block of that type would have to be purchased for each V-value.

d. Method in which the Angle of the Sheet is Measured by a Contact Piece

In the case of this method a surface is pressed until it is against the folded sheet. The angle which the surface forms is measured. This is then also the angle of the folded sheet. The system exists in two versions.

In a first version the side walls of the vee-block itself are rotatable, and the angle thereof is measured. However, the vee-block broadens as a result, so that the same disadvantages as those of the other known methods apply.

In a second version the contact piece is on the outside of the vee-block, which again prevents short folding.

SUMMARY OF THE INVENTION

The method according to the invention, i.e. an adaptive folding method, is a method by means of which excellent folding results can be obtained, even if the properties of the sheets vary.

The method according to the invention is a method in which a metal sheet is deformed in a recess of a die through a pressure means being moved above the recess, pressing on the sheet, towards the die until it reaches a well-defined end position.

Said method is characterized in that the movement of the pressure means is regulated as a function of the folding force and of the folding angle in order, on the one hand, to obtain a well-defined angle before the spring-back of the sheet and, on the other hand, to compensate for the spring-back of the sheet, so that after the spring-back the desired angle is obtained.

The pressure means is preferably moved in the direction of the die to an end position which is calculated during the folding process according to the formula:

$$Ya=Yt-dYw-dYr$$

in which dYw is the correction of the position of the pressure means which is necessary for obtaining the well-defined angle before the spring-back of the sheet, and which through extrapolation of the course of the folding angle is determined as a function of the position of the pressure means, and dYr is the correction of the position of the pressure means which is necessary to compensate for the spring-back of the sheet. For example, dYr can be calculated as dYr=dDr×(dY/dD), dDr being an empirical value for the spring-back, and dY/dD being the differential which is determined from the course D(Y) of the folding angle D as a function of position (Y) of the pressure means. However, dYr can also be determined from the course of the folding force as a function of the position of the pressure means.

In one embodiment the method is characterized in that a. The pressure means is driven in the direction of position Yt, which is calculated by means of a theoretical folding formula. While the pressure means is moving towards the die and the sheet is thus being folded, the course of the folding angle D as a function of the position of the pressure means Y is calculated, and dYw is calculated from this. The pressure means stops when it reaches the position Yt. An alternative is that it stops when the position Yw=Yt−dYw is reached.

b. The pressure means is moved over an arbitrary distance away from the die, so that a spring-back of the sheet occurs, while the course of the folding force as a function of the position of the pressure means is measured.

c. The pressure means is moved in the direction of the die until it is in the end position, which is calculated during the folding process according to the formula:

$$Ya=Yt-dYw-dYr$$

in which dYw is the correction of the position of the pressure means which is needed to obtain the well-defined angle before the spring-back of the sheet, and which is determined through extrapolation of the course of the folding angle as a function of the position of the pressure means, and dYr is the correction of the position of the pressure means which is needed to compensate for the spring-back of the sheet, and which is determined from the course of the folding force as a function of the position of the pressure means, or which is calculated as dYr=dDr×(dY/dD), dDr being an empirical value for the spring-back, and dY/dD being the differential which is determined from the course D(Y) of the folding angle D as a function of the position (Y) of the pressure means.

The correction dYw is advantageously calculated according to the formula:

$$dYw=(Dt-Dw).dY/dD$$

in which dY/dD is the differential which is determined from the course of the folding angle as a function of the position of the pressure means, while the correction dYr is advantageously calculated according to the formula: dYr=Yr−Yt, in which Yr is determined through extrapolation of the course at a folding force which is equal to zero, and Yt is the position of the pressure means (at a folding force which is equal to 100%, thus just before spring-back).

The folding force can be measured in a multiplicity of pressure pieces disposed below the die and/or with the aid of strain gauges.

The half folding angle is preferably measured by determining the coordinates of one point on the underside of the sheet and by determining the gradient of the straight line through said point and touching the lead curve of the die, and the folding angle is taken as double the half folding angle. Said half folding angle is advantageously measured on either side of the fold in the sheet, and the folding angle is taken as the sum of the two half folding angles.

For example, a tracer is placed in a reference position by a means, such as a stop, provided thereon. Said tracer contains a telescopic element which is placed against the underside of the sheet, as a result of which the coordinates of a point on the underside of the sheet are calculated from the position of the telescopic element.

The present invention also relates to a device for folding a sheet, comprising a table on which a die is disposed and a pressure means for folding a sheet in a recess provided for the purpose.

In one embodiment a multiplicity of pressure pieces is disposed in the table below the die, strain gauges being fitted in said pressure pieces for the purpose of measuring the folding force.

In one embodiment the device comprises a tracer (e.g. movably disposed) for measuring the angle, which tracer is provided at one end with a telescopic element and with a means for setting up the tracer in a reference position, which telescopic element in this reference position can be extended until it is against the underside of a sheet placed on the die.

The device advantageously also comprises means for recording the extended position of said element and for determining the folding angle of the sheet from said position.

A calibration block can be used to determine the relation between the signal generated by the tracer and the folding angle.

According to a characteristic of that embodiment, one end of at least one lever is rotatably fixed to the tracer, while the other end of said lever is rotatably fixed to a fixed part of the device. The device also comprises an immovably fixed actuator, a part of which can be driven so that it assumes at least two positions. Said part is rotatably fixed to a lever, so that in a first position of said part the tracer assumes the reference position, and in a second position of said part the tracer is positioned outside the working range of the die.

BRIEF DESCRIPTION OF THE DRAWINGS

Other features and details of the invention will emerge from the following description, in which reference is made to the appended drawings, in which.

DETAILED DESCRIPTION OF THE DRAWING

Figure 1:
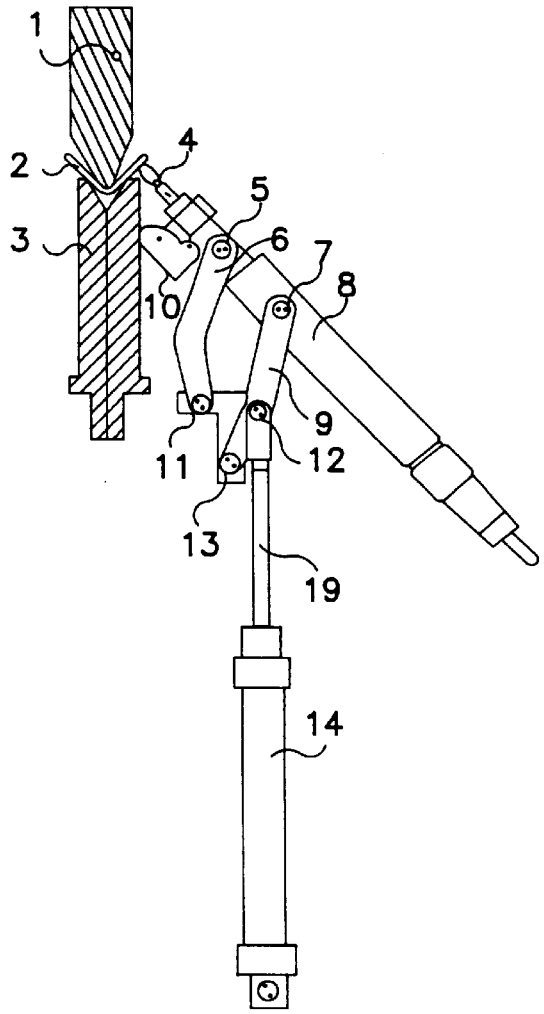
FIG. 1 shows a device for folding a sheet.

An embodiment of a method according to the invention will be described below.

In said method a metal sheet 2 is folded to a well-defined angle Dw through deformation of the sheet 2 in a recess 31 of a die 3. For said deformation a pressure means 1 is moved above the recess 31, pressing on the sheet 2, towards the die 3 to a well-defined end position Ya.

Using a theoretical folding formula, the position Yt to which the pressure means or the punch 1 must move in order to obtain the desired folding angle Dw is calculated.

The punch 1 is driven towards said calculated position Yt, as a result of which the sheet 2 is folded. During folding of the sheet 2 the course D(Y) as a function of the position Y or the movement of the punch 1 is measured.

The moment the calculated position Yt of the punch 1 is reached, the actual folding angle Dt is measured (i.e. before spring-back). The difference between the desired angle Dw and the angle Dt obtained is called dDw. The value dYw is calculated as dDw×dY/dD. This is the depth compensation which would be necessary to obtain the desired angle Dw without taking spring-back into account. The force present at that moment is called Ft and considered to be equal to 100%.

The punch is now driven upwards until the force has decreased to Fe, which is x% of the force Ft. A position Ye is now reached. The value Yr is determined from the regression of the curve F(Y) between Yt and Ye. The value dYr=Yr−Yt is equal to the depth compensation which would be needed to compensate for the spring-back of the material.

In another embodiment dYr is calculated as:

$$dYr = dDr \times (dY/dD)$$

$$dYr = Yr - Yt$$

Through the spring-back, Yr=Yt (1−α), in which α is ± constant for a type of sheet and can be calculated, for example, as follows:

$$a \cong \left| \frac{Yt - Ye}{Ft - Fe} \right| \times 100$$

in which Y is the distance between die and punch. dY/dD can easily be determined from the course D(Y) as a function of Y.

For example, dY/dD can be determined as follows:

$$Yt - Yf/Dt - Df$$

The punch is now driven to the position Ya=Yt−dYw−dYr. After spring-back the angle Dw will be obtained.

In that advantageous embodiment each fold is thus made in 3 phases: The punch first goes down to position Yt or Yw, then comes up a little (e.g. to position Ye if the punch was moved in the first step to position Yt), and then goes down to the final position.

The force is measured by measuring the deformation somewhere along the force path. This is carried out by means of strain gauges which are fitted in the pressure pieces 17 of the bending table 16. The signal from the strain gauges is a measure of the force which the machine undergoes as a result of the material to be folded.

A force transducer is built into each pressure piece. The force where the folding is being carried out can always be measured by said force transducer. Even in the case of short, thin sheets requiring only a small folding force, this ensures that an accurate force signal can still be obtained.

The folding angle D is measured by direct measurement of the half folding angle d. This angle is determined as the gradient of the straight line through a point on the underside of the sheet and touching the lead curve of the vee-block. Otherwise d is measured on both sides, and D=d_left+d_right; or d is measured only at 1 side, and D=2×d.

The coordinates of the point on the underside of the sheet are calculated from the position of the pin 4 of a distance sensor 8. The distance sensor thus has the function of a tracer, and is called a tracer below. The signal from the tracer is a measure of the folding angle.

Figure 2:
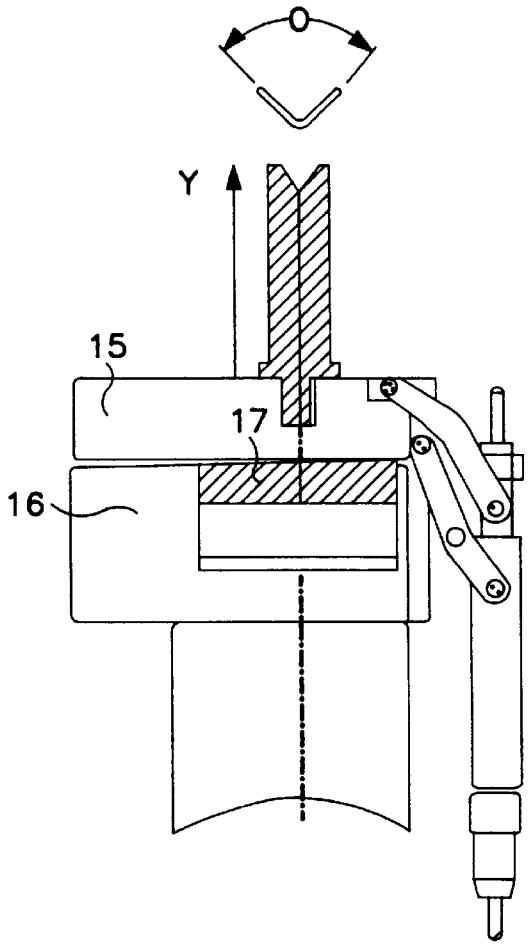
FIG. 2 shows a tracer for measuring the angle.

The tracer is positioned only when the fold is being made. In order to achieve the movement of the tracer, it is connected in the hinges 5 and 7 to two levers 9 and 6. The lower lever 9 is immovably fixed in hinge 13 and is driven in hinge 12 by an actuator 14. The actuator is, for example, a pneumatic cylinder. Lever 6 has hinge 11 as the fixed centre of rotation. The reference position of the tracer is determined through stop 10, which is immovably connected to the tracer 8, striking against the vee-block 3 (see FIG. 2).

When the actuator 14 is not activated, the tracer is withdrawn to below the level of the table 15. The working range thus becomes entirely free, and there is nothing at all to impede the positioning of the sheet or the folding itself (position of the actuator as shown in FIG. 1).

Figure 3:
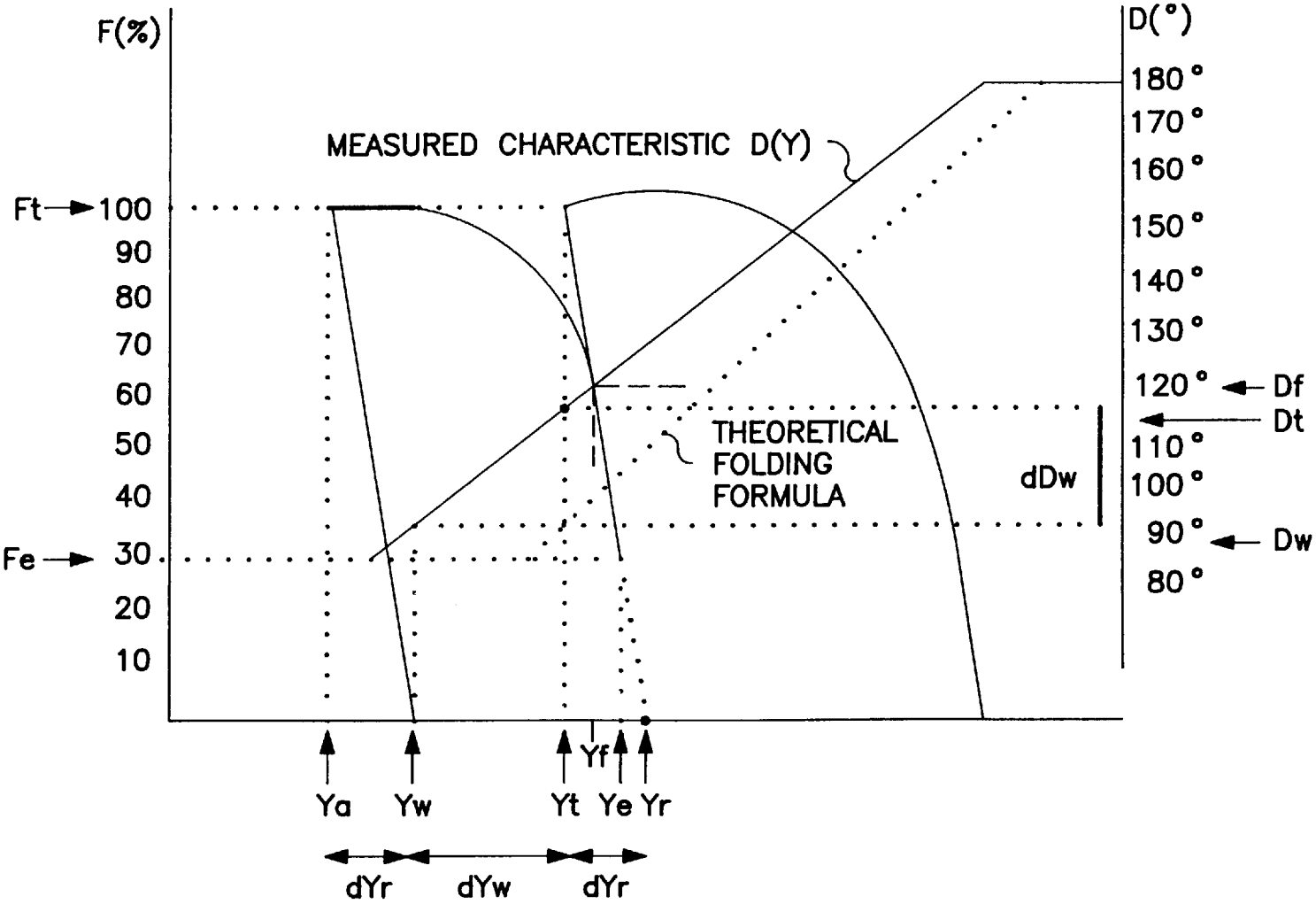
FIG. 3 shows a graph which indicates the force F and the angle D as a function of the movement Y of the punch.

A specific example will now be described with reference to FIG. 3.

Using a theoretical folding formula TP, as a function of the movement of the punch Y, the theoretical position Yt or movement of the punch in order to obtain the desired folding angle Dw, e.g. 90°, is calculated.

During the folding, the actual folding angle D(Y) is measured, in particular continuously, for various movements Y, as a result of which the course of D(Y) is determined.

For the theoretical movement Yt of the punch 1 there is a difference dDw between the actual folding angle Dt (114°) and the desired folding angle Dw (90°).

The differential dY/dD is measured in the region of Dt for the course D(Y), as a result of which the correction dYw of the movement of the punch 1 is calculated, in order to obtain the desired folding angle.

$$dYw = (Dt[114°] - Dw[90°]) \frac{dY}{dD}$$

The force Ft for obtaining the actual final folding angle Dt (114°) is measured.

During the upward drive of the punch 1 (i.e. the removal of the punch 1 from the sheet 2) the force F exerted on the sheet 2 is reduced. The movement of the punch 1 is controlled until a certain force Fe, which is preferably lower than 50% of Ft, e.g. 30% of Ft, is obtained. The movement of the punch Ye until Fe is obtained is measured.

The course F as a function of Y is determined in this way.

The abovementioned course F can be used to calculate the depth compensation Yr−Yt (=dYr) needed to compensate for the spring-back.

The punch 1 is then driven to the position or movement Ya=Yt−dDw−dYr, with the result that after the removal of the punch 1 and no further exertion of a force, the desired folding angle Dw is obtained.

What is claimed is:

1. A method of folding a metal sheet to a well-defined angle in the recess of a die comprising the steps of:

moving a pressure means having a position Y above the recess toward a position Yt which is calculated according to a theoretical formula, the moving pressure means pressing the sheet towards the die and forming a fold in the sheet having folding angle D, regulating the movement of the pressure means as a function of the folding force exerted on the sheet and as a function of the folding angle D to obtain a well-defined angle before the springback of the sheet, the folding force and the folding angle D being functions of the position Y of the pressure means, measuring the course of the folding angle D of the sheet as a function of the position Y of the pressure means, said measuring conducted at least in the region of the position Yt, determining a necessary correction dYw to the position of the pressure means in order to obtain the well-defined angle before the spring-back of the sheet, the determination being made through extrapolation of the course of the folding angle D of the sheet and as a function of position Y of the pressure means, stopping the pressure means when it reaches the position Yt, moving the pressure means over an arbitrary distance away from the die, so that a spring-back of the sheet occurs, measuring the course of the folding force as a function of the position Y of the pressure means during its movement away from the die, and moving the pressure means in the direction of the die until it is in the end position Ya, the value Ya is calculated according to the formula $$Ya=Yt-dYw-dYr$$

in which dYr is the correction of the position of the pressure means which is needed to compensate for the spring-back of the sheet and which is determined from the course of the folding force as a function of the position Y of the pressure means.

2. A method for folding a metal sheet to a well-defined angle according to claim 1, in which the pressure means is moved until it reaches the calculated position Yt−dYw, and in which dYr is calculated as dDr×dY/dD, dDr being an empirical value for the spring-back of the metal sheet, and dY/dD being the differential which is determined from the course of the folding angle D of the metal sheet as a function of position Y of the pressure means.

3. A method for folding a metal sheet to a well-defined angle according to claim 2, in which the correction dYw is calculated according to the formula:

$$dYw=(Dt-Dw)\cdot dY/dD$$

in which Dw is the desired angle, and dY/dD is a differential determined from the course of the folding angle D of the metal sheet as a function of the position Y of the pressure means.

4. A method for folding a metal sheet to a well-defined angle according to claim 1, in which the pressure means is moved until it reaches the calculated position Yt−dYw and the pressure means is thereafter moved away from the die until it is in a position Ye wherein the spring-back of the sheet is not complete, and in which the correction dYr is calculated according to the formula:

dYr=Yr−Yt, in which Yr is determined through extrapolation of the course of the folding force as a function of the position Y of the pressure means, said determination of Yr made at a folding force which is equal to zero, and Yt is the position of the pressure means when the pressure means is moved away from the die.

5. A method for folding a metal sheet to a well-defined angle, according to claim 1, in which the folding force is measured in one pressure piece disposed below the die.

6. A method for folding a metal sheet to a well-defined angle, according to claim 1, in which the folding force is measured by strain gauges.

7. A method for folding a metal sheet to a well-defined angle, according to claim 1, in which a half folding angle d is measured by determining the coordinates of one point on the underside of the sheet and by determining the gradient of the straight line through said point and touching the lead curve of the die, and in which the folding angle D of the metal sheet is taken as double the measured half folding angle d.

8. A method for folding a metal sheet to a well-defined angle, according to claim 1, in which a half folding angle d is measured on either side of the fold in the sheet, and in which the folding angle D is taken as the sum of the two half folding angles d.

9. A method for folding a metal sheet to a well-defined angle, according to claim 7, in which a tracer is placed in a reference position by placing a stop provided thereon against a side of the die and placing a telescopic element of said tracer against the underside of the sheet, and in which the coordinates are calculated from a point on the underside of the sheet from the position of the telescopic element.

10. A method for folding a metal sheet to a well-defined angle, according to claim 7, in which a tracer is placed in a reference position by placing a stop provided thereon against a side of the die, and in which a telescopic element of said tracer is placed against the underside of the metal sheet, wherein the coordinates are calculated from a point on the underside of the metal sheet from the position of the telescopic element, and in which the tracer is removed from the vicinity of the die when the folding angle D does not have to be measured.

11. A method for folding a metal sheet to a well-defined angle, according to claim 8, in which a tracer is placed in a reference position by placing a stop provided thereon against a side of the die and a telescopic element of said tracer is placed against the underside of the sheet wherein the coordinates are calculated from a point on the underside of the sheet from the position of the telescopic element.

12. A method for folding a metal sheet to a well-defined angle, according to claim 8, in which a tracer is placed in a reference position by placing a stop provided thereon against a side of the die, in which a telescopic element of said tracer is placed against the underside of the sheet, in which the coordinates are calculated from a point on the underside of the sheet from the position of the telescopic element, and in which a tracer is removed from the vicinity of the die when the folding angle does not have to be measured.

13. A device for folding a sheet, comprising a table on which a die is disposed, and a pressure means for folding a sheet in the recess of the die, in which a multiplicity of pressure pieces are disposed in the table below the die, said pressure pieces containing gauges therein for measuring the folding force, and in which the device contains means for calculating the end position of the pressure means during a folding method in which the sheet is deformed in the recess of a die, the method comprising the steps of:

moving a pressure means having a position Y above the recess toward a position Yt which is calculated according to a theoretical formula, the moving pressure means pressing the sheet towards the die forming a fold in the sheet having folding angle D, regulating the movement of the pressure means as a function of the folding force exerted on the sheet and as a function of the folding angle D to obtain a well-defined angle before the springback of the sheet, said folding force and said folding angle D being functions of the position Y of the pressure means, measuring the course of the folding angle D of the metal sheet as a function of the position Y of the pressure means, said measuring conducted at least in the region of the position Yt, determining a necessary correction dYw to the position of the pressure means in order to obtain the well-defined angle before the spring-back of the sheet, the determination being made through extrapolation of the course of the folding angle D of the metal sheet as a function of position Y of the pressure means, stopping the pressure means when it reaches the position Yt, moving the pressure means over an arbitrary distance away from the die, so that a spring-back of the sheet occurs, measuring the course of the folding force as a function of the position Y of the pressure means during its movement away from the die, moving the pressure means in the direction of the die until it is in the end position Ya, the value Ya is calculated according to the formula $$Ya=Yt-dYw-dYr$$

in which dYr is the correction of the position of the pressure means which is needed to compensate for the spring-back of the sheet and which is determined from the course of the folding force as a function of the position Y of the pressure means.

14. A device for folding a sheet comprising:

a table on which a die is disposed, pressure means for folding a sheet in a recess on the die, a tracer provided at one end with a telescopic element, wherein the tracer is movable, means for disposing the tracer in a reference position, wherein the telescopic element in this reference position can be extended until it is against the underside of a sheet placed on the die, means for recording the extended position of the telescopic element and for determining from said position the folding angle D of the sheet, at least one lever having two ends, one end of said lever rotatably fixed to the tracer and the other end of the lever rotatable fixed to a fixed part of the device, and an immovably fixed actuator, a part of the actuator driven so that it may assume at least two positions the driven part of the actuator rotatably fixed to a lever, so that the tracer assumes the reference position in the first position of the driven part of the actuator and the tracer is positioned outside the working range of the die in the second position of the driven part of the actuator.

15. A device for folding a sheet according to claim 14, in which the tracer is positioned below the level of the table in the second position of said part of the actuator.

16. A device for folding a sheet according to claim 14, in which the actuator is a pneumatic cylinder, wherein the piston rod of the pneumatic cylinder is rotatably fixed to a lever.

* * * * *